US006193059B1

(12) United States Patent
Massaro

(10) Patent No.: US 6,193,059 B1
(45) Date of Patent: Feb. 27, 2001

(54) APPARATUS FOR STORING A TOILET PLUNGER AND TOILET PAPER

(76) Inventor: Frank Massaro, 561 173rd Ave. E., North Redington Beach, FL (US) 33708

( * ) Notice: Subject to any disclaimer, the term of this patent is extended or adjusted under 35 U.S.C. 154(b) by 0 days.

(21) Appl. No.: 09/495,577

(22) Filed: Feb. 1, 2000

(51) Int. Cl.[7] ..... B65D 85/672; A47G 29/08; B65G 57/20

(52) U.S. Cl. ..... 206/225; 206/361; 206/394; 206/15.3; 312/42; 312/45; 312/207

(58) Field of Search ..... 206/225, 394, 206/361, 15.2, 15.3; 312/42, 45, 206, 207; D6/520, 523, 524, 551; 4/255.11

(56) References Cited

U.S. PATENT DOCUMENTS

| | | | | |
|---|---|---|---|---|
| D. 206,135 | * | 11/1966 | O'Neil | D6/551 |
| D. 237,232 | * | 10/1975 | Garrett | D6/520 |
| D. 330,984 | | 11/1992 | Evans . | |
| D. 393,389 | | 4/1998 | Thurston-Chartraw et al. . | |
| 3,275,133 | * | 9/1966 | Wood | 206/394 |
| 4,177,958 | | 12/1979 | Poole . | |
| 4,192,561 | * | 3/1980 | Gunn | 312/42 |
| 4,273,392 | * | 6/1981 | Stinson | 312/42 |
| 4,314,679 | | 2/1982 | Paul et al. . | |
| 4,432,451 | * | 2/1984 | Hooser | 206/225 X |
| 4,607,809 | | 8/1986 | Sineni et al. . | |
| 5,114,006 | | 5/1992 | Wilk . | |
| 5,301,888 | | 4/1994 | Danzi . | |
| 5,887,818 | | 3/1999 | Kelley . | |
| 5,927,492 | | 7/1999 | Moore . | |
| 5,984,100 | * | 11/1999 | Rousey et al. | 206/361 X |
| 6,038,709 | * | 3/2000 | Kent | 206/153 X |

* cited by examiner

*Primary Examiner*—Bryon P. Gehman
(74) *Attorney, Agent, or Firm*—Larson & Larson, PA; James E. Larson

(57) ABSTRACT

Outside and inside cylindrical containers store a toilet plunger and multiple rows of toilet paper. The outside container has a base with side vent holes and a cap with vent holes. A toilet plunger resides vertically in the container. The inside container has a central bore in a base plate through to a tube through which the handle of the plunger protrudes upwardly. Multiple rolls of toilet paper are mounted axially on the tube within the inside container. A pull rod on the outside of the inner container tube is used to lift the toilet rolls from the inner container.

9 Claims, 5 Drawing Sheets

APPARATUS FOR STORING A TOILET PLUNGER AND TOILET PAPER

FIELD OF THE INVENTION

This invention relates to an apparatus for hiding a bathroom toilet plunger. More particularly, it refers to a container for storing a toilet plunger and spare toilet paper, together with a decorative exterior on the container.

BACKGROUND OF THE INVENTION

Placement of an exposed toilet plunger in a bathroom is unsightly and undesirable. On the other hand, when a toilet plunger is stored in an out of sight location, it may not be easily accessible when needed. Therefore, it is desirable to have a toilet plunger close at hand in a bathroom, but within a decorative container as shown in U.S. Pat. No. 5,927,492, or in a housing as shown in U.S. Pat. No. 5,114,006.

Toilet paper can sometime be critically unavailable when a bathroom toilet paper hanger becomes empty. To solve this problem a toilet paper holder and multiple dispenser, such as shown in U.S. Pat. No. 4,607,809, has been proposed.

Of course, it would be desirable for reasons of space and convenience to have both a toilet plunger and toilet paper dispenser located within the same container. A problem arises in the danger of contaminating the toilet paper with the toilet plunger. A need arises for a decorative container for both a toilet plunger and toilet paper, but with a safeguard against contamination of the toilet paper.

SUMMARY OF THE INVENTION

This invention solves the problem by providing a decorative container for both a toilet plunger and toilet paper without the fear of contaminating the toilet paper. The novel apparatus of this invention has several components. There is a first cylindrical container having air and water drainage holes in a bottom side surface adjacent a base plate and a top cover having air vent holes. Inside the container is a toilet plunger having a vertical handle on which is mounted a second cylindrical container having a smaller exterior diameter than the interior diameter of the first cylindrical container. The second cylindrical container has a hole through a base cover through which the handle of the toilet plunger protrudes within a vertical tube within the interior container vertical tube. Two or more rolls of toilet paper are axially mounted on the vertical tube. The vertical tube has an exterior diameter smaller than the interior diameter of a toilet paper roll. A vertically movable pull rod is mounted through the toilet paper rolls so that toilet paper can be lifted from the second cylindrical container as needed.

Indicia can be placed on the exterior of the first container to provide an ornamental look to the first container. A thin clear cylindrical plastic shield can enclose the indicia to protect it from soiling.

BRIEF DESCRIPTION OF THE DRAWINGS

The invention can be best understood by those having ordinary skill in the art by reference to the following detailed description when considered in conjunction with the accompanying drawing in which.

DETAILED DESCRIPTION OF THE INVENTION

Figure 1:
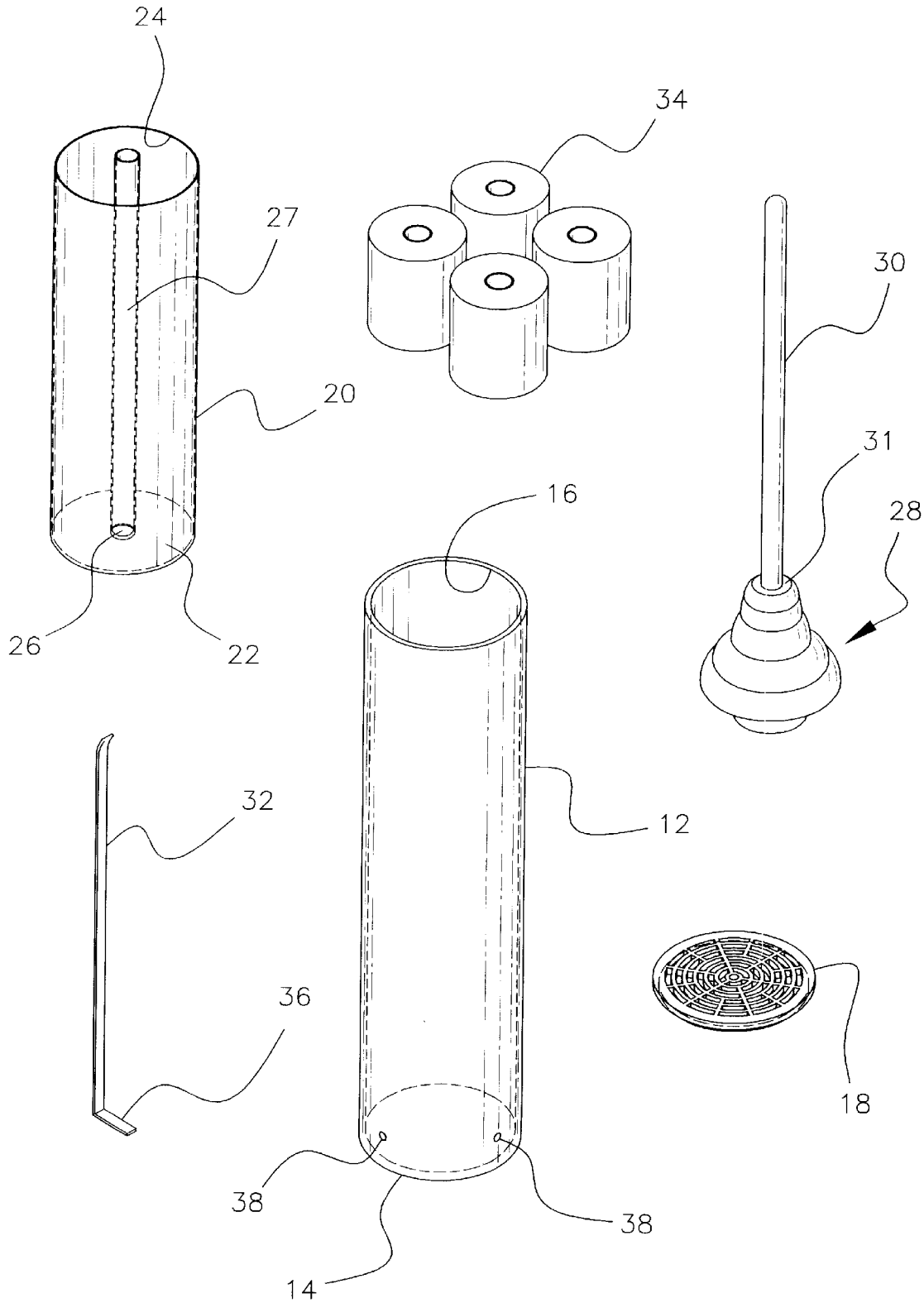
FIG. 1 is a prospective view of all the components of the subject invention.

Throughout the following detailed description, the same reference numerals refer to the same elements in all figures.

Figure 6:
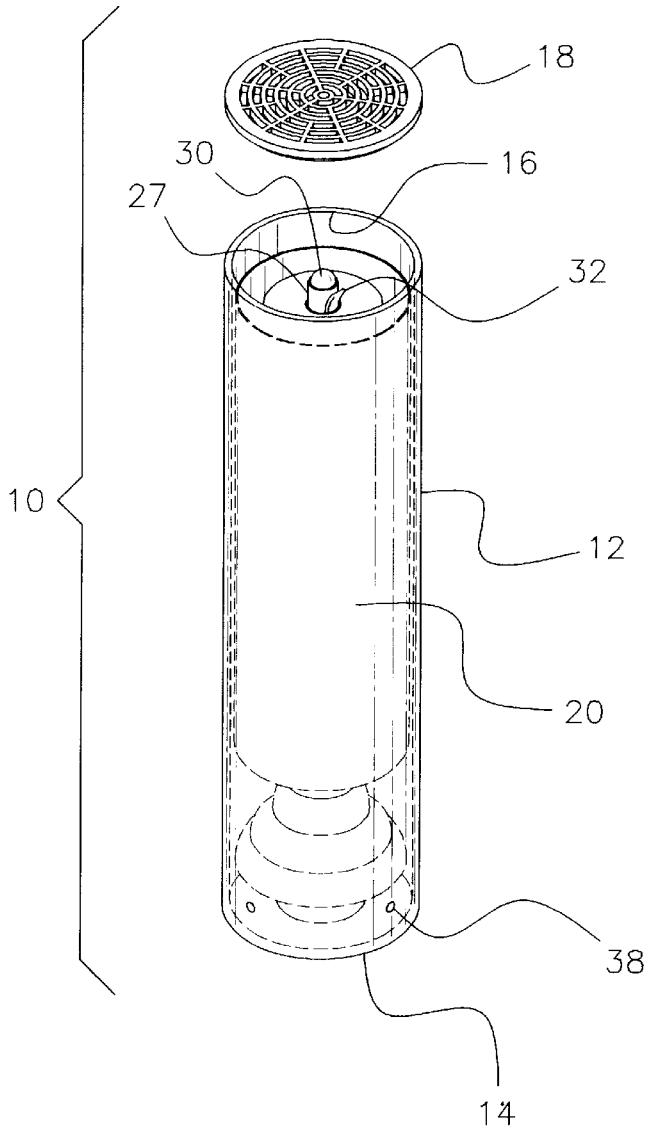
FIG. 6 is an elevational view partially in phantom of the apparatus of this invention.
Figure 7:
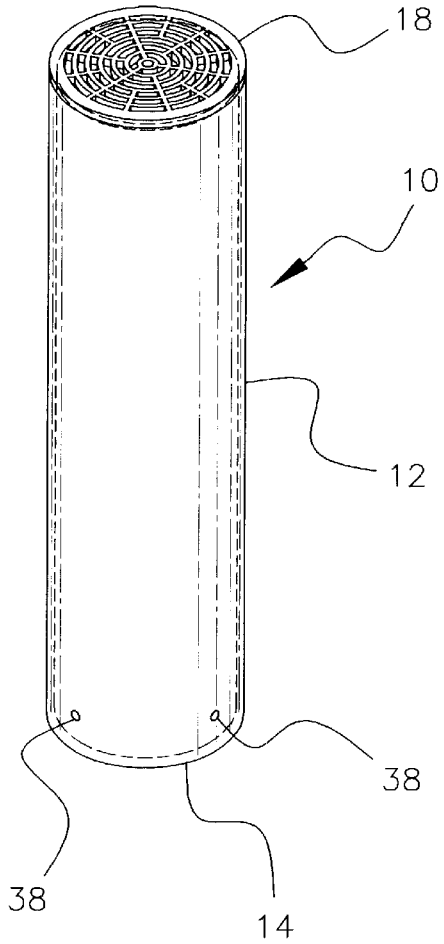
FIG. 7 is an elevational view of the apparatus of this invention.

The apparatus 10 of this invention shown in FIGS. 6–7 has several components in combination as seen in FIG. 1. An outer cylindrical container 12 has a closed base 14 and open top 16. Air holes 38 on a side surface adjacent the base plate 14 provide a basis for air circulation through the cylinder 12. A grated cap 14 is placed over the top of container 12 when it is filled.

Figure 2:
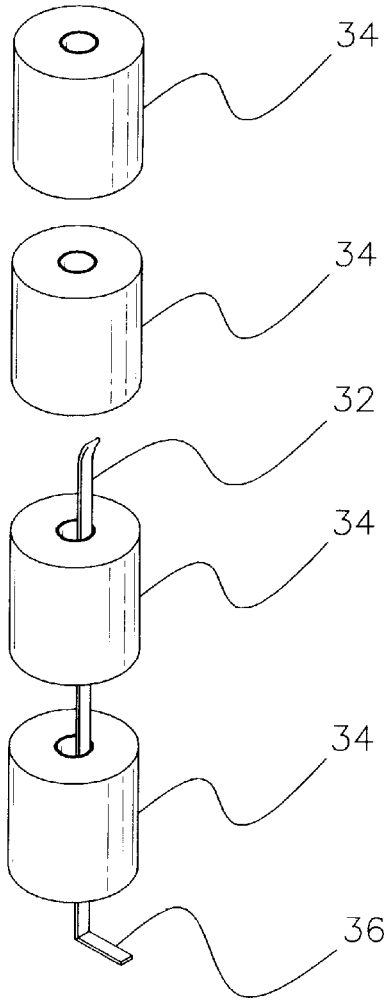
FIG. 2 is an exploded view of the toilet paper rolls mounted on the pull rod.
Figure 3:
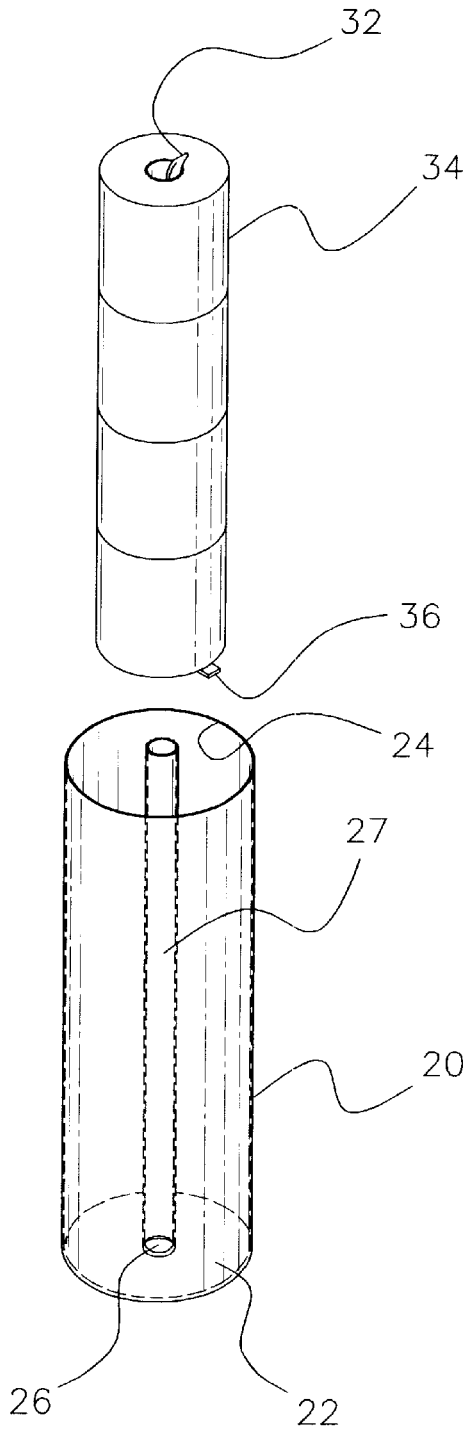
FIG. 3 is an exploded view of the toilet paper rolls about to be mounted within the interior container.
Figure 4:
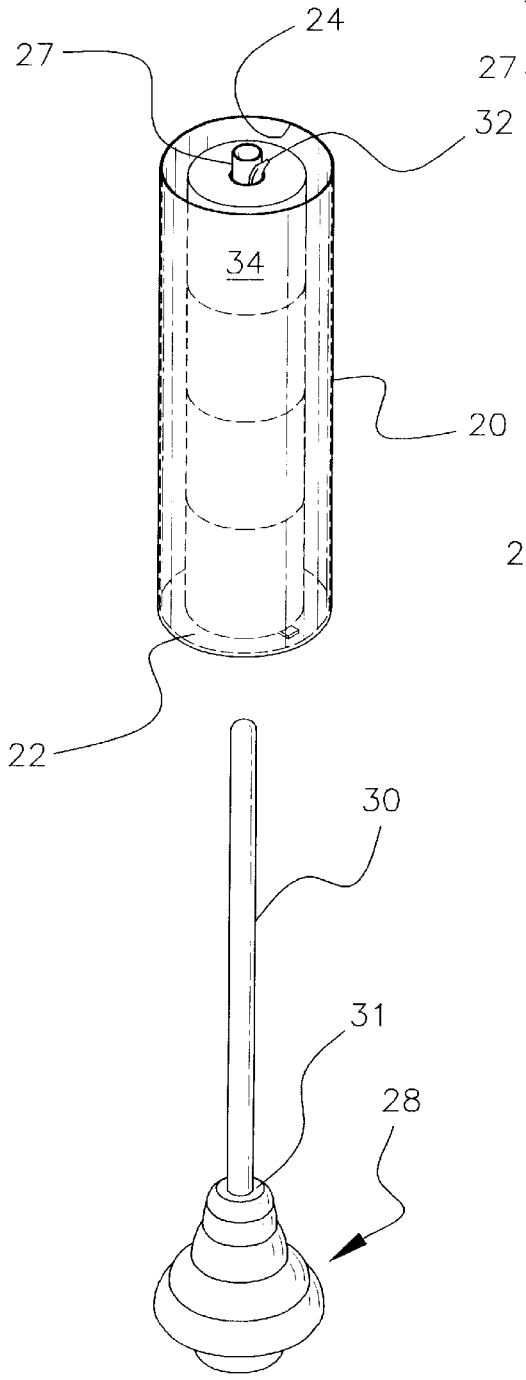
FIG. 4 is an exploded view of the inner container about to be mounted over the plunger handle.
Figure 5:
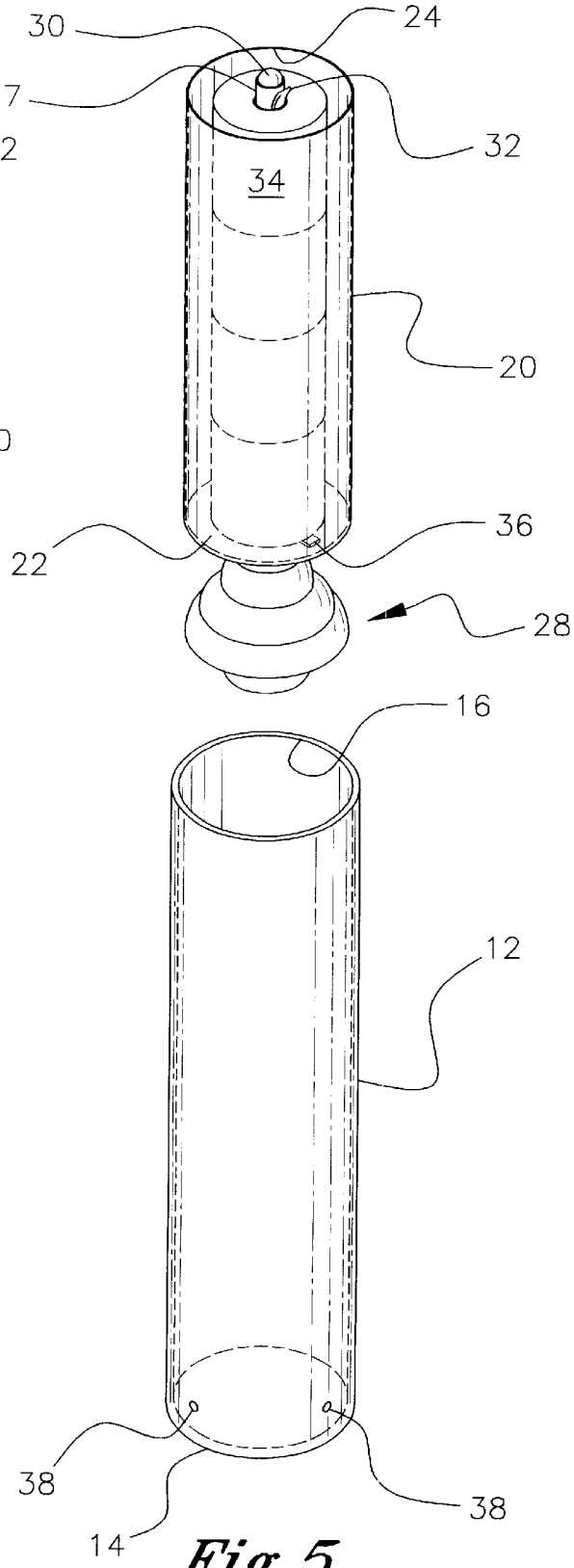
FIG. 5 is an exploded view of the inner container mounted on the plunger handle about to be placed in the exterior container.

An inner container 20 having a closed base 22 with a central hole 26 and an open top 24, together with an interior axial tube 27 is placed over the handle 30 of a plunger 28. Hole 26 and the inner diameter of tube 27 is sufficiently large to be placed over handle 30, but is smaller in diameter than the top shelf 31 of plunger 28. Therefore, the inner container 20 will sit in place on top of top shelf 31 of plunger 28. Multiple rolls of toilet paper 34 are placed over pull rod 32 as seen in FIG. 2. A flange 36 on the bottom of pull rod 32 prevents the toilet paper rolls from falling off pull rod 32. The pull rod 32 and toilet paper rolls 34 are mounted over tube 27 in inner container 20 and then the inner container is mounted over the handle 30 of the plunger 28 as shown in FIG. 4. Thereafter, the plunger 28 with the inner container 20 mounted over the handle 30 is placed within outer container 12 so that the plunger 28 rests on base plate 14 (FIG. 5) and cover plate 18 is placed over the top 16 of container 12 to make a complete apparatus as shown in FIGS. 6–7.

Figure 8:
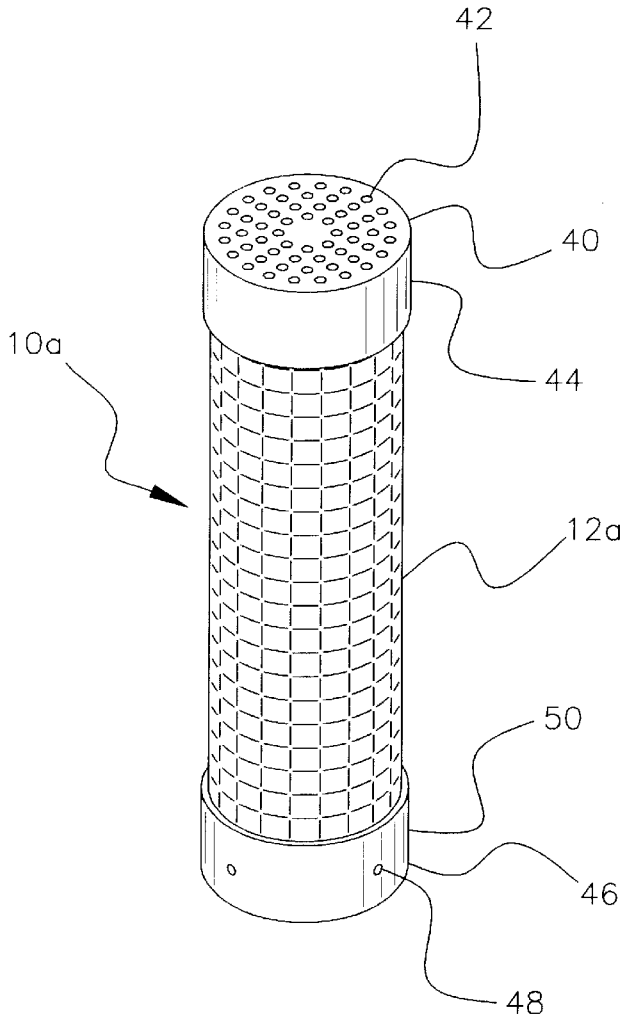
FIG. 8 is an elevational view of an alternative exterior container of this invention.
Figure 9:
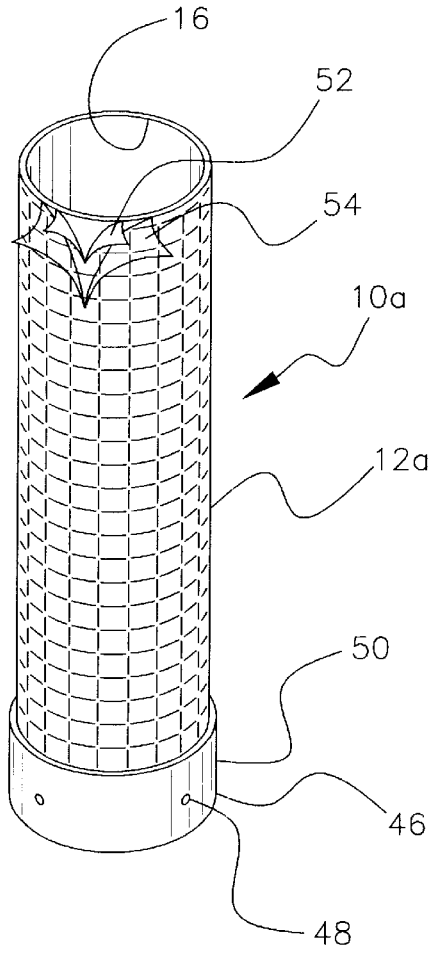
FIG. 9 is an elevational view of the container of FIG. 8 showing the indicia layer and outer clear plastic layer.

Alternatively, container 12 can be modified as shown in FIGS. 8–9 to make container 12*a*. Container 12*a* has a top cap 40 having multiple air holes 42 in a top surface and a descending side surface skirt 44. A bottom cap 46 has side holes 48 and an upwardly directed side skirt 50. Container 12*a* can have an exterior side cover 52 containing indicia such as wall paper, or other decorative coatings. This outer paper layer 52 is covered by a clear plastic layer 54 to prevent the indicia from being soiled.

The outer container 12 and inner container 20 of this invention are preferably made of a polymer, such as polyvinyl styrene, polyvinyl chloride, polyethylene and the like. Of course, the containers 12 and 20 can also be made of metal, such as aluminum or steel. The pull rod 32 can be made of a metal, such as aluminum or steel, or a molded plastic, such as polyvinyl styrene, polyvinyl chloride, polyethylene, or the likes. Preferably, the top plate 18 is metal for stability, but can also be a plastic material as described above. Plunger 28 normally has a wooden handle 30, but this also can be a plastic material as in well known in the prior art.

In the alternative container 12*a*, the outer sheet 52 contain the indicia, usually made of a paper material containing indicia, but also can be a plastic material that is capable of receiving indicia. The outer clear plastic layer can be polyvinyl chloride, or other clear plastic material. The caps 40 and 46 are preferably made of a plastic material of the type described for containers 12 and 20 above.

An air freshener can be hooked on the rim of the exterior container 12 for aesthetic purposes.

The tube 27 must have a suitable interior diameter to receive handle 30 and have an exterior diameter smaller than an interior diameter of a standard roll of toilet paper.

The above description has described specific structural details in the embodiment of the invention. However, it will be within one having skill in the art to make modifications without departing from the spirit and scope of the underlying inventive concept of this toilet plunger-toilet paper container. The inventive concept is not limited to the structure described, but includes such modifications except as limited by the scope of the inventive claims.

Having thus described the invention, what is claimed and desired to be secured by Letters Patent is:

1. An apparatus for storing both a toilet plunger and multiple rolls of toilet paper comprising:

(a) an exterior cylindrical container having a base cover and a top cover having at least one air passageway;

(b) a toilet plunger resting on an inner surface of the base cover of the exterior container, the toilet plunger having an upwardly protruding handle;

(c) an interior cylindrical container having a base plate containing a central bore leading to a vertical tube through which the handle protrudes, the interior cylinder having an outer diameter less than the inner diameter of the exterior cylindrical container, the inner container mounted within the exterior cylindrical container, the interior cylinder having an open top and an inner diameter more than the outer diameter of a toilet paper roll;

(d) multiple rolls of toilet paper mounted axially around the vertical tube in the interior container; and (e) a pull rod with an attached bottom flange mounted along an outer vertical surface of the vertical tube in the inner container, the bottom flange located below the bottom said roll of toilet paper so that lifting of the pull rod will cause the multiple rolls of toilet paper to be moved upwardly out of the inner and outer containers and the toilet plunger being removable from the exterior container by lifting a top portion of the handle upwardly.

2. The apparatus according to claim 1 wherein an outer surface of the exterior container is at least partially covered with indicia.

3. The apparatus according to claim 2 wherein the outer surface of the exterior container is enclosed by a clear plastic cylinder to protect the indicia.

4. The apparatus according to claim 1 wherein the base cover has an integral upwardly projecting cylindrical skirt covering a bottom portion of the exterior cylinder.

5. The apparatus according to claim 1 wherein the top cover has an integral downwardly projecting cylindrical skirt covering a top portion of the exterior cylinder.

6. The apparatus according to claim 1 wherein the top cover is in the form of a grate.

7. The apparatus according to claim 1 wherein four rolls of toilet paper are mounted axially on the handle.

8. The apparatus according to claim 2 wherein the indicia is a wall paper design.

9. The apparatus according to claim 1 wherein multiple holes are located on a side surface of the exterior cylindrical container adjacent the base cover.

* * * * *